US007362300B2

(12) United States Patent
Hirama

(10) Patent No.: US 7,362,300 B2
(45) Date of Patent: Apr. 22, 2008

(54) OUTPUT CIRCUIT, LIQUID CRYSTAL DRIVING CIRCUIT, AND LIQUID CRYSTAL DRIVING METHOD

(75) Inventor: Atsushi Hirama, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 618 days.

(21) Appl. No.: 10/873,266

(22) Filed: Jun. 23, 2004

(65) Prior Publication Data

US 2005/0151714 A1 Jul. 14, 2005

(30) Foreign Application Priority Data

Jan. 13, 2004 (JP) ..... 2004-005739

(51) Int. Cl.
*G09G 3/36* (2006.01)

(52) U.S. Cl. ..... 345/98; 345/100

(58) Field of Classification Search ..... 345/98, 345/100

See application file for complete search history.

(56) References Cited

U.S. PATENT DOCUMENTS 4,410,855 A 10/1983 Underhill et al.
6,154,192 A * 11/2000 Katakura et al. ..... 345/98
6,756,962 B1 * 6/2004 Akimoto et al. ..... 345/98
6,919,870 B2 * 7/2005 Fukuda ..... 345/100

FOREIGN PATENT DOCUMENTS

| | | |
|---|---|---|
| JP | 49-69060 | 7/1974 |
| JP | 52109436 U | 8/1977 |
| JP | 57078222 | 5/1982 |
| JP | 07007289 A | 1/1994 |
| JP | 11-030975 | 2/1999 |
| JP | 11030975 | 2/1999 |

* cited by examiner

*Primary Examiner*—Richard Hjerpe
*Assistant Examiner*—Kevin M Nguyen
(74) *Attorney, Agent, or Firm*—Volentine & Whitt, P.L.L.C.

(57) ABSTRACT

An output circuit for driving a signal line in, for example, a liquid crystal display panel has an impedance conversion element that generates an output signal from an input signal and a feedback signal. During output periods, a first switch conducts the output signal to the output terminal of the output circuit and a second switch conducts the output signal from the output terminal back to the impedance element as the feedback signal. During non-output periods, the first and second switches are switched off and a third switch conducts the output signal back to the impedance element as the feedback signal from a point between the impedance conversion element and the first switch. This dual feedback scheme enables the signal line to be precharged during non-output periods while avoiding loss of driving speed and accuracy during output periods.

13 Claims, 9 Drawing Sheets

OUTPUT CIRCUIT, LIQUID CRYSTAL DRIVING CIRCUIT, AND LIQUID CRYSTAL DRIVING METHOD

BACKGROUND OF THE INVENTION

1. Field of the Invention

The present invention relates to an output circuit employing feedback control, a liquid crystal driving circuit that uses the output circuit to drive a liquid crystal panel, and a liquid crystal driving method that uses the output method of the output circuit to drive a liquid crystal panel.

2. Description of the Related Art

As disclosed in Japanese Unexamined Patent Application Publication No. 11-30975, the driving speed of a liquid crystal display panel having source lines driven by operational amplifiers can be increased by precharging the source lines. The source lines are precharged by disconnecting them from their drivers (the operational amplifiers) and either interconnecting the source signal lines, or connecting them to a fixed potential such as the common-voltage potential of the liquid crystal display panel.

FIG. 8 illustrates the former precharging scheme in a conventional liquid crystal display including a liquid crystal panel 1, a gate driving circuit 2, a source driving circuit 3, a group of m source lines $S_1, S_2, \ldots, S_m$, and a group of n gate lines $G_1, G_2, \ldots, G_m$, where m and n are positive integers, m being equal to or greater than two. The liquid crystal panel 1 includes cell transistors $TR_{ij}$ and capacitors $CX_{ij}$ ($1 \leqq i \leqq m$, $1 \leqq j \leqq n$). The gate driving circuit 2 includes gate drivers $GD_j$ ($1 \leqq j \leqq n$).

Referring to FIG. 9, the source driving circuit 3 comprises m source drivers $SD_1, SD_2, \ldots, SD_m$, connected through respective analog switches $A_1, A_2, \ldots, A_m$ to respective output terminals $OUT_1, OUT_2, \ldots, OUT_m$, a group of m−1 analog switches $D_1, D_2, \ldots, D_{m-1}$ by which mutually adjacent source lines are switchably interconnected, and an inverter I. A single output circuit comprises a source driver $SD_i$, the corresponding analog switches $A_i$, $D_i$, and output terminal $OUT_i$ (where i is an arbitrary integer from 1 to m). The source driver $SD_i$ is an operational amplifier receiving a source driving signal $SS_i$ as its non-inverting input, generating a corresponding output signal for driving source line $S_i$, and feeding the output signal back as its inverting input. Feedback ensures that the output signal has the same potential as the source driving signal $SS_i$. Various other impedance conversion means controlled by feedback can also be used as the source driver $SD_i$.

Analog switches $A_1$ to $A_m$ and $D_1$ to $D_{m-1}$ are controlled by a switch control signal PC input to inverter I and a complementary switch control signal PCB output from inverter I. When switch control signal PC is '0' and PCB is '1', analog switches $A_1$ to $A_m$ all turn on and analog switches $D_1$ to $D_{m-1}$ all turn off, so that output terminals $OUT_1$ to $OUT_m$ (and source lines $S_1$ to $S_m$) are connected to the output terminals of respective source drivers $SD_1$ to $SD_m$ and the output signals from the source drivers $SD_1$ to $SD_m$ are output on source lines $S_1$ to $S_m$. When switch control signal PC goes to '1' and switch control signal PCB goes to '0', analog switches $A_1$ to $A_m$ all turn off and analog switches $D_1$ to $D_{m-1}$ all turn on, disconnecting output terminals $OUT_1$ to $OUT_m$ (and source lines $S_1$ to $S_m$) from the source drivers $SD_1$ to $SD_m$ and interconnecting all of the output terminals and source lines; the output terminals and source lines are thereby precharged. When switch control signal PC returns to '0' and switch control signal PCB returns to '1', analog switches $A_1$ to $A_m$ all turn on and analog switches $D_1$ to $D_{m-1}$ all turn off, disconnecting output terminals $OUT_1$ to $OUT_m$ (and source lines $S_1$ to $S_m$) from each other and connecting them to the source drivers $SD_1$ to $SD_m$.

Although the purpose of this precharging scheme is faster driving, to enable the source drivers to receive feedback during the precharging period, the feedback signals must be taken from points between the source drivers and the analog switches $A_1$ to $A_m$. Consequently, during driving periods, the source drivers must drive the on-resistance of these analog switches as well as the capacitance of the capacitors in the liquid crystal panel. Because of the voltage drop due to the on-resistance of the analog switches, the potentials of the output terminals of the source driving circuit 3 differ from the potentials of the signals output by the source drivers. Although the potential difference diminishes and eventually disappears as the capacitors approach and eventually reach the intended charge level, the potential difference slows the approach, thereby limiting the speed with which the liquid crystal panel can be driven. A further problem is that variations in wiring resistance due to variations in the on-resistance of the analog switches and the wiring length of the output paths create unwanted variations in driving potential among the output terminals (and source lines), impairing the accuracy with which the liquid crystal panel 1 is driven, leading to lowered image quality. As the number of pixels increases and the driving frequency increases, driving the liquid crystal panel accurately at the necessary speed becomes a significant challenge.

SUMMARY OF THE INVENTION

An object of the present invention is to provide an output circuit in which an impedance conversion element, switchably connectable to an output terminal, can rapidly generate an output signal at the correct potential level at the output terminal.

A further object is to provide a circuit and method for rapidly and accurately driving a liquid crystal display panel.

The impedance conversion element in the invented output circuit generates an output signal from an input signal and a feedback signal. An output path conducts the output signal from the impedance conversion element to the output terminal of the output circuit. The output path includes a first switch that conducts the output signal during output periods and blocks the output signal during non-output periods. A second switch conducts the output signal from a first point on the output path to the impedance conversion element as the feedback signal during the output periods. A third switch conducts the output signal from a second point on the output path to the impedance conversion element as the feedback signal during the non-output periods. The first point is disposed at the output terminal, or between the first switch and the output terminal; the second point is disposed between the impedance conversion element and the first switch.

The second switch provides feedback of the potential at the output terminal to the impedance conversion element. By comparing the feedback signal with the input signal, the impedance conversion element can quickly and accurately adjust its output so that the desired potential is obtained at the output terminal of the output circuit.

Output circuits of the invented type can be used to drive a liquid crystal display panel accurately at high speed. The output terminals and their connected signal lines can be precharged during the non-output periods.

DETAILED DESCRIPTION OF THE INVENTION

Figure 1:
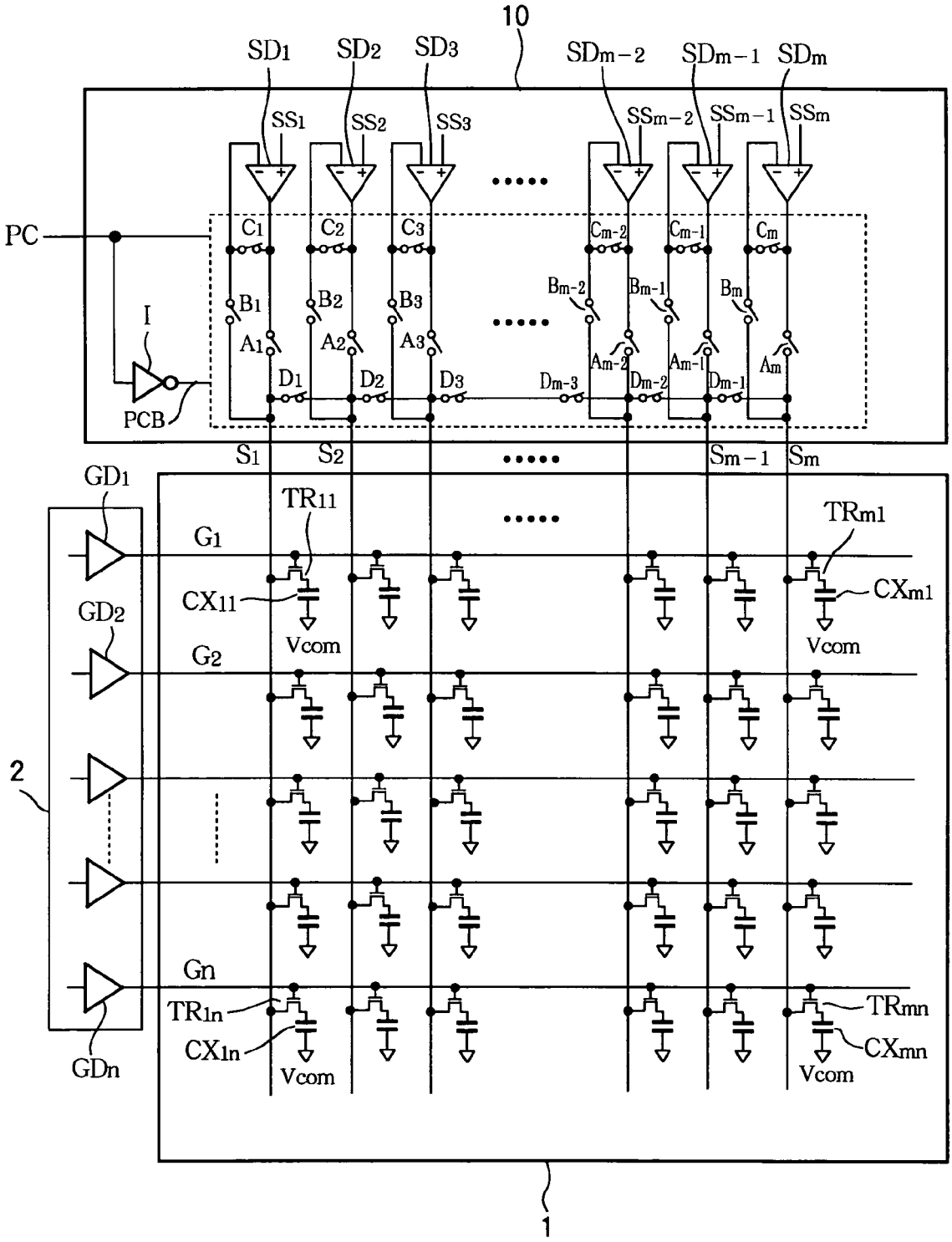
FIG. 1 is a circuit diagram of a liquid crystal display according to a first embodiment of the invention.

Embodiments of the invention will now be described with reference to the attached drawings, in which like elements are indicated by like reference characters.

Figure 2:
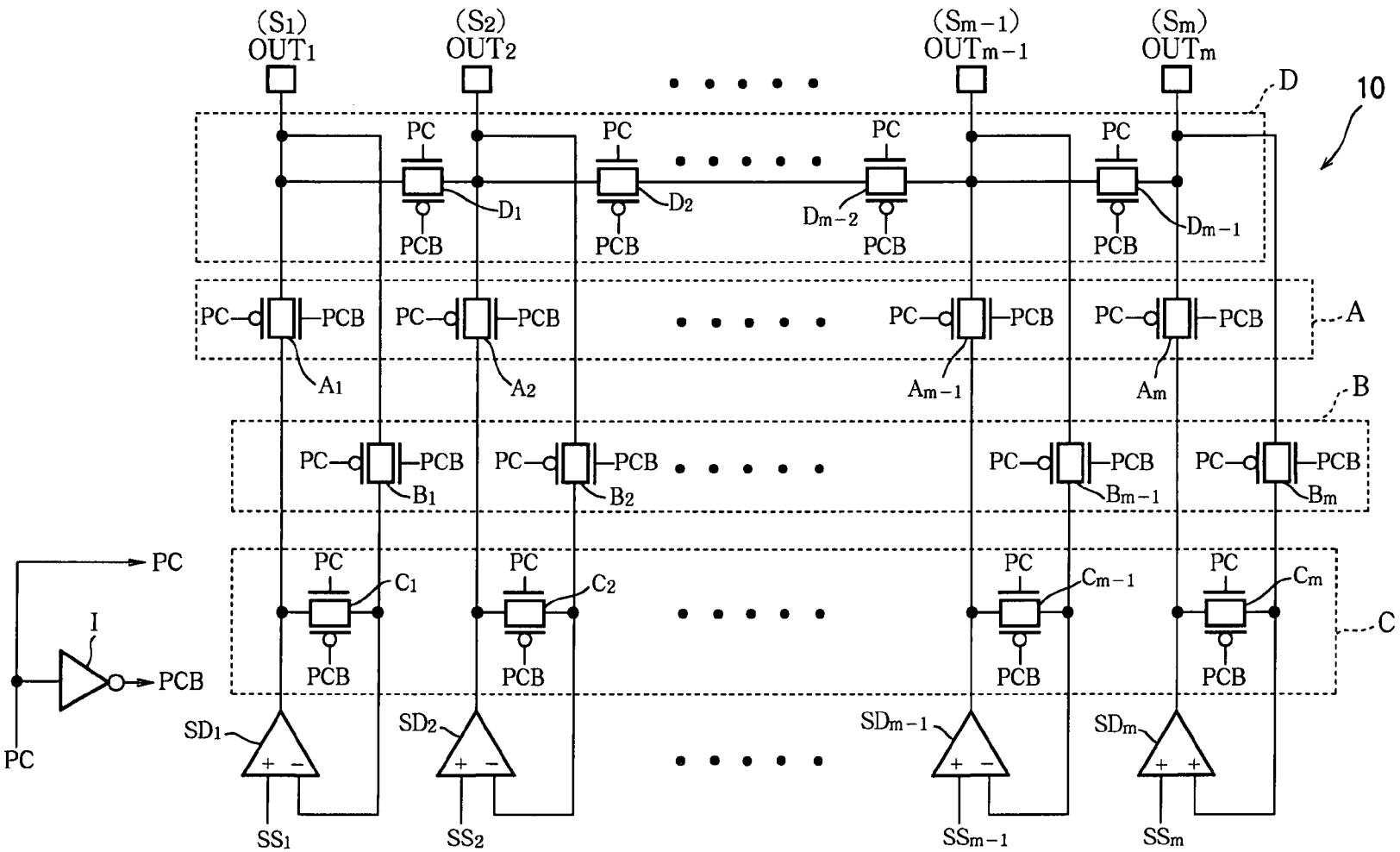
FIG. 2 is a more detailed circuit diagram of the source driving circuit in FIG. 1.

Referring to FIG. 1, a liquid crystal display according to a first embodiment of the invention comprises a liquid crystal panel 1, a gate driving circuit 2, a source driving circuit 10, a group of source lines, and a group of gate lines. FIG. 2 shows the circuit configuration of the source driving circuit 10 in more detail.

The group of source lines comprises m source lines $S_1$, $S_2$, . . . , $S_m$ (where m is an arbitrary integer equal to or greater than two); the group of gate lines comprises n gate lines $G_1$, $G_2$, . . . , $G_n$ (where n is an arbitrary integer equal to or greater than two). The source lines and gate lines form a set of matrix lines for driving an m×n matrix of liquid crystal cell switching transistors.

The liquid crystal panel 1 comprises the m×n switching transistors $TR_{12}$, $TR_{22}$, . . . , $T_{mn}$ and m×n liquid crystal cell capacitors $CX_{11}$, $CX_{21}$, . . . , $CX_{m1}$, $CX_{12}$, $CX_{22}$, . . . , $CX_{mn}$. Switching transistor $TR_{ij}$ and liquid crystal cell capacitor $CX_{ij}$ form a liquid crystal cell (i is an integer from 1 to m; j is an integer from 1 to n). The liquid crystal panel 1 has a matrix of m×n liquid crystal cells.

The source and drain of switching transistor $TR_{ij}$ are connected between source line $S_i$ and the cell electrode of liquid crystal cell capacitor $CX_{ij}$; the gate of $TR_{ij}$ is connected to gate line $G_j$. The common electrode of liquid crystal cell capacitor $CX_{ij}$ is connected to a common power source $V_{com}$.

The gate driving circuit 2 has n gate drivers $GD_1$, $GD_2$, . . . , $GD_n$. The gate driving circuit 2 uses gate driver $GD_j$ to drive gate line $G_j$.

As shown in FIGS. 1 and 2, the source driving circuit 10 in the first embodiment comprises the m source drivers $SD_1$, $SD_2$, . . . , $SD_m$, an A-group of analog switches ($A_1$ etc.) that control output paths, a B-group of analog switches ($B_1$ etc.) that control first feedback paths, a C-group of analog switches ($C_1$ etc.) that control second feedback paths, a D-group of analog switches ($D_1$ etc.) that control precharging, a group of m output terminals $OUT_1$, $OUT_2$, . . . , $OUT_m$, and an inverter I. Each analog switch comprises a p-channel metal-oxide-semiconductor (PMOS) transistor and an n-channel metal-oxide-semiconductor (NMOS) transistor connected in parallel, as can be seen in FIG. 2.

The i-th source driver $SD_i$ is an operational amplifier with a non-inverting input terminal to which a source driving signal $SS_1$ is input, an output terminal from which a signal is output to drive the i-th source line $S_i$ to the potential of the input source driving signal $SS_1$, and an inverting input terminal to which the output signal is fed back. The source driver $SD_i$ operates as a voltage-follower buffer amplifier with high-impedance input and low-impedance output.

The invention is not limited to the use of operational amplifiers. Various types of impedance conversion means including a buffer or amplifier can be used as the source driver $SD_i$.

The A-group of analog switches comprises m analog switches (MOS switches) $A_1$, $A_2$, . . . , $A_m$. Analog switch $A_i$ is connected between the output terminal of the i-th source driver $SD_i$ and the i-th output terminal $OUT_i$ of the source driving circuit 10, thus between the output terminal of source driver $SD_i$ and source line $S_i$. The gate electrode of the PMOS transistor in analog switch $A_i$ receives a switch control signal PC (the input signal to the inverter I); the gate electrode of the NMOS transistor in analog switch $A_i$ receives a complementary switch control signal PCB (the output signal from the inverter I). Analog switch $A_i$ turns off if switch control signal PC is at the logical '1' level (PC=1, PCB=0), thereby disconnecting the output terminal of source driver $SD_i$ from output terminal $OUT_i$ (source line $S_i$); analog switch $A_i$ turns on if PC is at the logical '0' level (PC=0, PCB=1), thereby connecting the output terminal of source driver $SD_i$ to output terminal $OUT_i$ (source line $S_i$). This embodiment assumes that the logical '0' level is low and the logical '1' level is high.

The B-group of analog switches comprises m analog switches (MOS switches) $B_1$, $B_2$, . . . , $B_m$. Analog switch $B_i$ is connected between the i-th output terminal $OUT_i$ (source line $S_i$) of the source driving circuit 10 and the inverting input terminal of source driver $SD_i$. The gate electrode of the PMOS transistor in analog switch $B_i$ receives switch control signal PC; the gate electrode of the NMOS transistor in analog switch $B_i$ receives switch control signal PCB. Analog switch $B_i$ turns off when PC=1 (PCB=0), thereby disconnecting the inverting input terminal of source driver $SD_i$ from output terminal $OUT_i$ (and source line $S_i$); analog switch $B_i$ turns on when PC=0 (PCB=1), thereby connecting the inverting input terminal of source driver $SD_i$ to output terminal $OUT_i$ (and source line $S_i$).

The C-group of analog switches comprises m analog switches (MOS switches) $C_1$, $C_2$, . . . , $C_m$. Analog switch $C_i$ is connected between the output and inverting input terminals of source driver $SD_i$. The gate electrode of the PMOS transistor in analog switch $C_i$ receives switch control signal PCB; the gate electrode of the NMOS transistor in analog switch $C_i$ receives switch control signal PC. Analog switch $C_i$ turns on if switch control signal PC=1 (PCB=0), thereby connecting the output terminal of source driver $SD_i$ to the inverting input terminal of source driver $SD_i$; analog switch $C_i$ turns off if switch control signal PC=0 (PCB=1), thereby disconnecting the output terminal of source driver $SD_i$ from the inverting input terminal of source driver $SD_i$.

The D-group of analog switches comprises m−1 analog switches (MOS switches) $D_1$, $D_2$, . . . , $D_{m-1}$ (there is no $D_m$) The i-th analog switch $D_i$ is connected between the i-th output terminal $OUT_i$ and the (i+1)-th output terminal $OUT_{i+1}$ of the source driving circuit 10, thus between source line $S_i$ and source line $S_{i+1}$. The gate electrode of the PMOS transistor in analog switch $D_i$ receives switch control signal PCB; the gate electrode of the NMOS transistor in analog switch $D_i$ receives switch control signal PC. Analog switch $D_i$ turns on if switch control signal PC=1 (PCB=0), thereby establishing a short circuit between source line $S_i$ and source line $S_{i+1}$ through output terminals $OUT_i$ and $OUT_{i+1}$ of the source driving circuit; analog switch $D_i$ turns off if switch control signal PC=0 (PCB=1), thereby breaking the short circuit that has been established between source lines $S_i$ and $S_{i+1}$ (and between the corresponding output terminals of the source driving circuit). In the first embodiment, a source line (and the corresponding output terminal of the source driving circuit) is precharged from other source lines (and other output terminals of the source driving circuit).

In the source driving circuit 10 of the first embodiment, source driver $SD_i$, analog switches $A_i$, $B_i$, $C_i$, and $D_i$, and output terminal $OUT_i$ form an output circuit.

Figure 3:
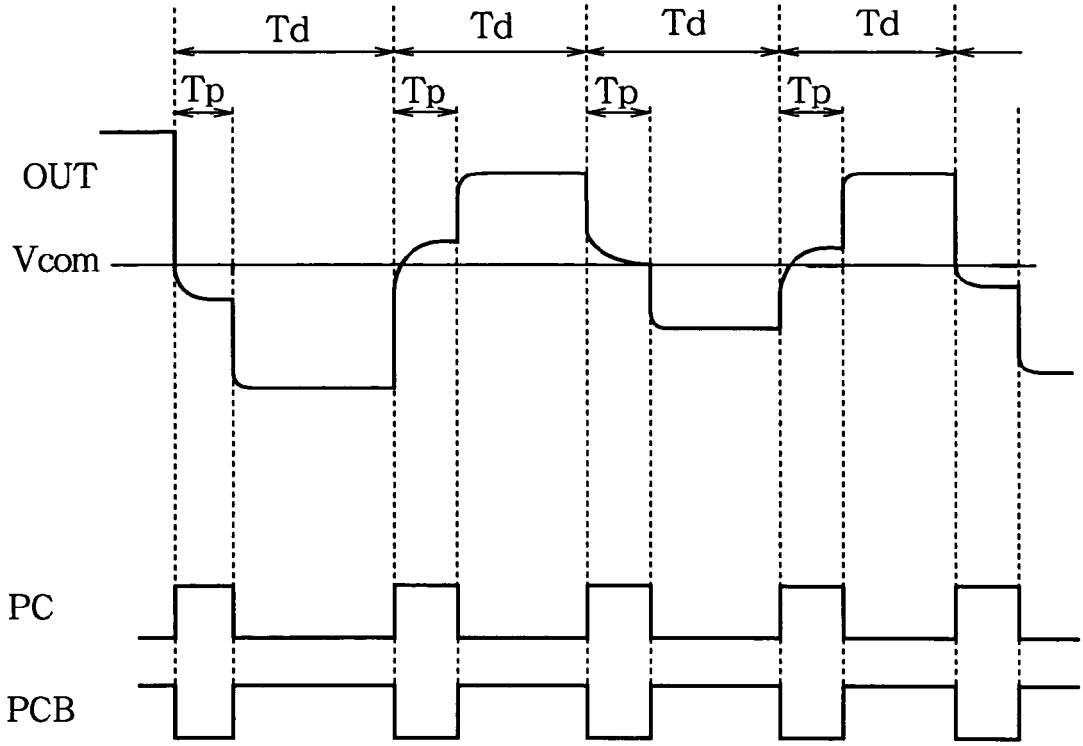
FIG. 3 is a timing waveform diagram illustrating the operation of the source driving circuit.

The operation of the source driving circuit 10 in the first embodiment will be described below with reference to FIG. 3, which shows waveforms of an output signal OUT of the source driving circuit 10 (the signal output from output terminal $OUT_i$ to source line $S_i$), the switch control signal PC, and the complementary switch control signal PCB. $T_d$ indicates the dot driving cycle time of the liquid crystal display, including both the driving (output) period and the precharging (non-output period); $T_p$ indicates the precharging (non-output) period.

During a precharging period, switch control signal PC is '1' and complementary switch control signal PCB is '0', so the A- and B-group analog switches are all in the off state, while the C- and D-group analog switches are all in the on state.

Since analog switches $A_i$ and $B_i$ are in the off state and analog switches $D_{i-1}$ and $D_i$ are in the on state, output terminal $OUT_i$ (and source line $S_i$) is disconnected from the output and inverting input terminals of source driver $SD_i$ and is connected via analog switches $D_{i-1}$ and $D_i$ to the adjacent output terminals $OUT_{i-1}$ (source line $S_{i-1}$) and $OUT_{i+1}$ (source line $S_{i+1}$). All of the output terminals $OUT_i$ and source lines $S_i$ ($1 \leqq i \leqq m$) are mutually interconnected in this way, so all of the output terminals $OUT_i$ and source lines $S_i$ are precharged to substantially the average output potential in the preceding driving period.

Since analog switch $B_i$ is off and analog switch $C_i$ is on, the output potential of source driver $SD_i$ is fed back to the inverting input terminal of source driver $SD_i$ via analog switch $C_i$. Since the input impedance of the inverting input of source driver $SD_i$ is extremely high, the potential fed back to the inverting input terminal of source driver $SD_i$ becomes equal to the output potential of source driver $SD_i$ regardless of the on-resistance in analog switch $C_i$. Since source driver $SD_i$ operates so as to make the potential of its inverting input (the output potential of source driver $SD_i$) equal to the potential of its non-inverting input (source driving signal $SS_i$), the output potential of source driver $SD_i$ equals the potential of source driving signal $SS_i$.

At the transition from the precharging period to the driving period, switch control signal PC goes to the '0' logic level and switch control signal PCB goes to the '1' logic level, switching all the C- and D-group analog switches off and all the A- and B-group analog switches on. Analog switches $D_{i-1}$ and $D_{i+1}$ accordingly turn off and analog switch $A_i$ turns on, disconnecting output terminal $OUT_i$ (source line $S_i$) from the adjacent output terminals $OUT_{i-1}$ (source line $S_{i-1}$) and $OUT_{i+1}$ (source line $S_{i+1}$) and connecting it to the output terminal of source driver $SD_i$ via analog switch $A_i$.

Analog switch $C_i$ turns off and analog switch $B_i$ turns on, switching from the second feedback path to the first feedback path, thereby feeding back the potential of output terminal $OUT_i$ (source line $S_i$) after the voltage drop caused by the on-resistance of analog switch $A_i$ to the inverting input terminal of source driver $SD_i$ via analog switch $B_i$. Since the input impedance at the inverting input terminal of source driver $SD_i$ is extremely high, the potential at the inverting input terminal of source driver $SD_i$ rapidly becomes equal to the potential of output terminal $OUT_i$ (source line $S_i$). Since source driver $SD_i$ operates so as to make the potential of its inverting input (the potential of output terminal $OUT_i$ or source line $S_i$) equal to the potential of its non-inverting input (source driving signal $SS_i$), the potential of output terminal $OUT_i$ (source line $S_i$) rapidly becomes equal to the potential of source driving signal $SS_i$.

At the precharging-to-driving transition, accordingly, the source driving circuit 10 in the first embodiment switches the feedback potential of the i-th output circuit from the potential at a point preceding analog switch $A_i$ to the potential at a point following analog switch $A_i$, thereby compensating for the voltage drop due to the on-resistance of analog switch $A_i$ so that the potential of output terminal $OUT_i$ (source line $S_i$) quickly becomes equal to the potential of source driving signal $SS_i$ (the input potential to source driver $SD_i$). This feedback arrangement also compensates for variations in voltage drop due to variations in on-resistance, resulting in both faster and more accurate driving of the source lines.

This feedback arrangement can also compensate for the voltage drop due to the resistance of the signal line from the output terminal of source driver $SD_i$ to the point at which analog switches $A_i$ and $B_i$ are interconnected, which accounts for most of the wiring resistance on the signal path from the output terminal of source driver $SD_i$ to output terminal $OUT_i$. This means that, if there are variations in wiring resistance (or wiring length) on the output paths, they can be compensated for completely, or almost completely, by interconnecting the analog switches $A_i$ and $B_i$ at output terminal $OUT_i$ or at a point located as near as possible to output terminal $OUT_i$.

During the driving period, switch control signal PC is '0' and switch control signal PCB is '1', so the A- and B-group analog switches are all in the on state and the C- and D-group analog switches are all in the off state.

Analog switches $D_{i-1}$ and $D_{i+1}$ are in the off state, and analog switch $A_i$ is in the on state, disconnecting output terminal $OUT_i$ (and source line $S_i$) from the adjacent output terminals $OUT_{i-1}$ and $OUT_{i+1}$ (and source lines $S_{i-1}$ and $S_{i+1}$) and connecting it to the output terminal of source driver $SD_i$ via analog switch $A_i$.

Analog switch $C_i$ is in the off state and analog switch $B_i$ is in the on state, feeding the potential of output terminal $OUT_i$ (source line $S_i$) back via analog switch $B_i$ on the first feedback path to the inverting input terminal of source driver $SD_i$, thereby keeping the potential of output terminal $OUT_i$ (source line $S_i$) equal to the potential of the non-inverting input (source driving signal $SS_i$) of source driver $SD_i$.

At the transition from the driving period to the next precharging period, switch control signal PC goes to '1' and switch control signal PCB goes to '0', switching all the A- and B-group analog switches off and all the C- and D-group analog switches on.

Analog switches $A_i$ and $B_i$ turn off and analog switches $D_{i-1}$ and $D_{i+1}$ turn on, disconnecting output terminal $OUT_i$ (and source line $S_i$) from the output and inverting input terminals of source driver $SD_i$, and connecting output terminal $OUT_i$ to adjacent output terminals $OUT_{i-1}$ and $OUT_{i+1}$ (and source lines $S_{i-1}$ and $S_{i+1}$) via analog switches $D_{i-1}$ and $D_{i+1}$, thereby precharging source line $S_i$.

Analog switch $B_i$ turns off and analog switch $C_i$ turns on, changing the feedback path from the first feedback path to the second feedback path, thereby feeding the output potential of source driver $SD_i$ back to the inverting input terminal of source driver $SD_{i-1}$ via analog switch $C_i$.

Figure 4:
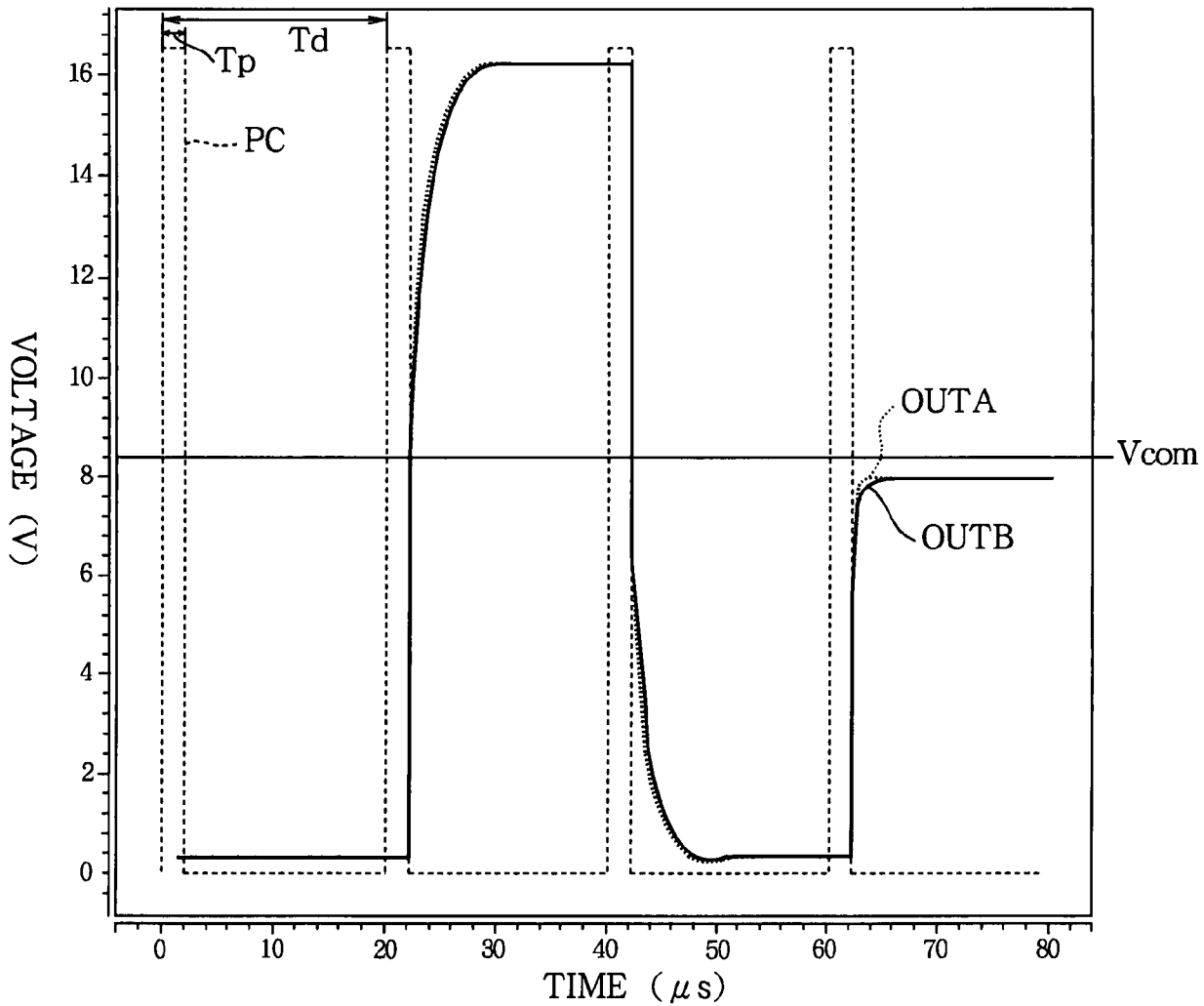
FIG. 4 is a waveform diagram comparing simulated output waveforms in the first embodiment and prior art.

FIG. 4 shows simulated waveforms of the switch control signal PC, an output signal OUTA of the source driving circuit 10 in the first embodiment, and an output signal OUTB of the conventional source driving circuit 3. $T_d$ indicates the dot driving cycle time of the liquid crystal display; $T_p$ indicates the precharging period. In the simulation shown in FIG. 4, dots are driven alternately positive and negative with respect to the common voltage $V_{com}$, and for simplicity, all dots are driven to the same potential, so precharging does not alter the potential.

As is evident from FIG. 4, the simulated output waveform OUTA in the first embodiment rises nearly ten percent (10%) faster than the simulated output waveform OUTB in the prior art. This improvement in rise time is particularly noticeable at intermediate driving potentials (potentials near the common voltage $V_{com}$).

As described above, the first embodiment provides a first feedback path from a point following the A-group analog switch to the source driver during the driving period and a second feedback path from a point preceding the A-group analog switch to the source driver during the precharging period, and switches the feedback path at transitions from the driving period to the precharging period and vice versa, thereby compensating for the voltage drop due to the on-resistance of the analog switch, and further compensating for variations in on-resistance and wiring resistance of the output path. The first embodiment thereby achieves fast and highly accurate liquid crystal driving. By precharging the source lines from adjacent source lines, the first embodiment also conserves power and eliminates the need for a special precharging power source.

Second Embodiment

Figure 5:
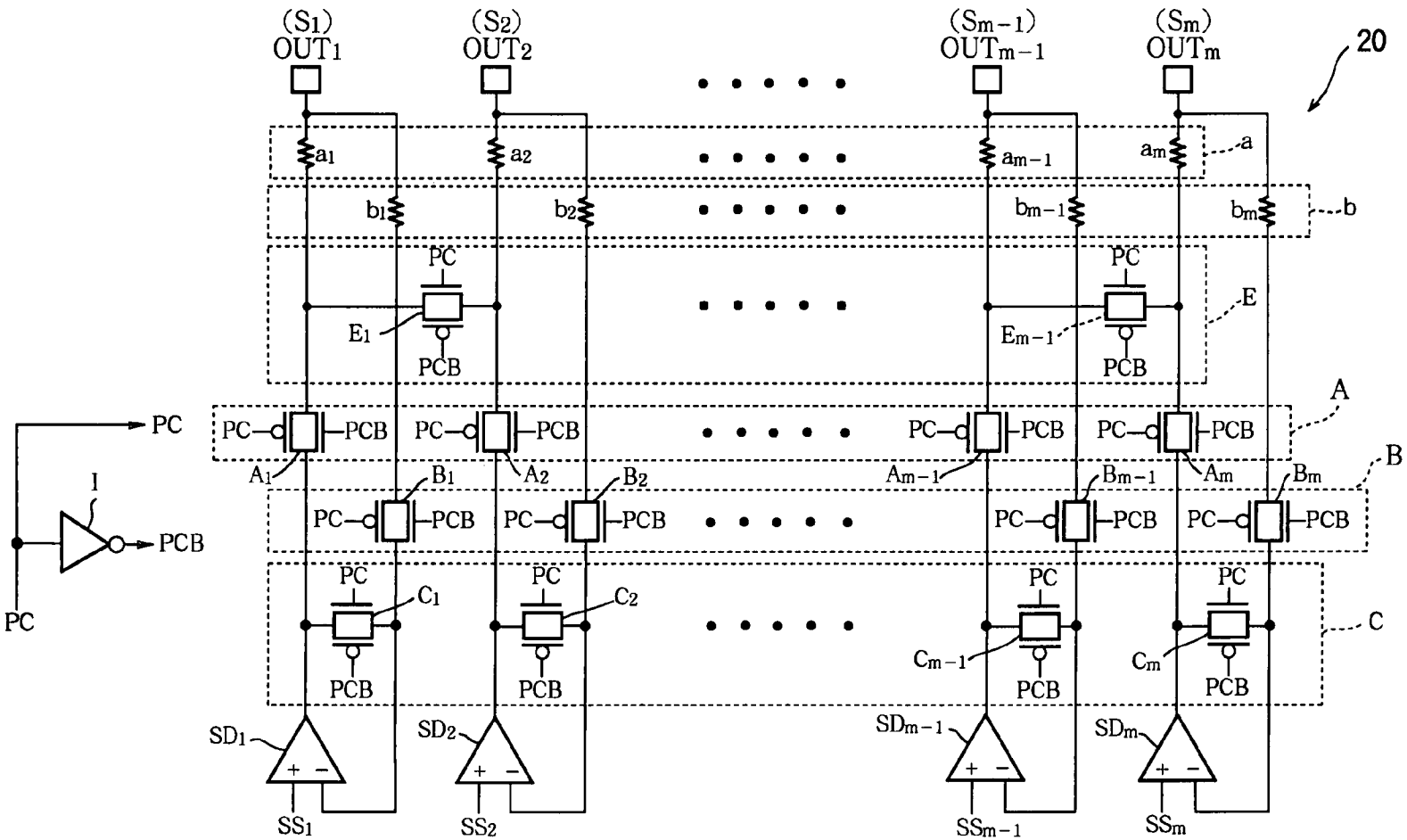
FIG. 5 is a circuit diagram of the source driving circuit in a second embodiment.

Referring to FIG. 5, the source driving circuit 20 in the second embodiment comprises m source drivers $SD_1$, $SD_2$, . . . , $SD_m$, an A-group of analog switches that control output paths, a B-group of analog switches that control first feedback paths, a C-group of analog switches that control second feedback paths, an E-group of analog switches that control precharging, an a-group of protective resistors, a b-group of feedback resistors, a group of m output terminals $OUT_1$, $OUT_2$, . . . , $OUT_m$, and an inverter I, where m is an even number.

The source driving circuit 20 accordingly adds protective resistors and feedback resistors to the source driving circuit 10 in the first embodiment, and alters the group of analog switches that control precharging. The source driving circuit 20 in the second embodiment also arranges the feedback paths during the driving period so that they branch from points following the protective resistors.

The E-group of analog switches comprises m/2 analog switches (MOS switches) $E_1$, $E_3$, . . . , $E_{m-3}$, $E_{m-1}$. The i-th analog switch $E_i$ (i being an odd number) interconnects source lines $S_i$ and $S_{i+1}$ through output terminals $OUT_i$ and $OUT_{i+1}$ of the source driving circuit, also being located between analog switches $A_i$ and $A_{i+1}$; no analog switch is provided to interconnect source lines $S_{i+1}$ and $S_{i+2}$ (analog switches $A_{i+1}$ and $A_{i+2}$). The number of analog switches in the E-group is therefore half the number of source lines, each analog switch in this group interconnecting two adjacent source lines.

The gate electrode of the PMOS transistor in analog switch $E_i$ receives switch control signal PCB (the output signal from inverter I); the gate electrode of an NMOS transistor in analog switch $E_i$ receives switch control signal PC (the input signal to inverter I). Analog switch $E_i$ turns on if switch control signal PC=1 (PCB=0), thereby establishing a short circuit between source $S_i$ and $S_{i+1}$ through output terminals $OUT_i$ and $OUT_{i+1}$ of the source driving circuit; analog switch $E_i$ turns off if switch control signal PC=0 (PCB=1), thereby breaking the short circuit that has been established between source lines $S_i$ and $S_{i+1}$ (and between the corresponding output terminals of the source driving circuit).

The a-group of protective resistors comprises m protective resistors $a_1$, $a_2$, . . . , $a_m$. The i-th protective resistor $a_i$ is connected between analog switch $A_i$ and output terminal $OUT_i$ (source line $S_i$) of the source driving circuit 20, and provides protection for analog switch $A_i$, analog switch $E_i$ or $E_{i-1}$, and source driver $SD_i$.

The b-group of feedback resistors comprises m feedback resistors $b_1$, $b_2$, . . . , $b_m$. The i-th feedback resistor $b_i$ is connected between analog switch $B_i$ and output terminal $OUT_i$ (source line $S_i$) of the source driving circuit 20, and provides protection for analog switch $B_i$ and source driver $SD_i$.

In the source driving circuit 20 of the second embodiment, source driver $SD_i$, analog switches $A_i$, $B_i$, $C_i$, and $E_i$, protective resistor $a_i$, feedback resistor $b_i$, and output terminal $OUT_i$ form an output circuit.

The operation of the source driving circuit 20 in the second embodiment will be described below with reference to FIG. 3, which shows waveforms of an output signal OUT of the source driving circuit 20 (the signal output from output terminal $OUT_i$ to source line $S_i$), the switch control signal PC and the complementary switch control signal PCB. Td indicates the dot driving cycle time of the liquid crystal display; $T_p$ indicates the precharging period.

During a precharging period, switch control signal PC is '1' and switch control signal PCB is '0', so the A- and B-group analog switches are all in the off state, while the C- and E-group analog switches are all in the on state.

Since analog switches $A_i$ and $B_i$ are in the off state and analog switch $E_i$ (or $E_{i-1}$) is in the on state, output terminal $OUT_i$ (source line $S_i$) is disconnected from the output and inverting input terminals of source driver $SD_i$ and is connected via analog switch $E_i$ (or $E_{i-1}$) to the adjacent output terminal $OUT_{i+1}$ (source line $S_{i+1}$) or $OUT_{i-1}$ (source line $S_{i-1}$), thereby being precharged.

Since analog switch $B_i$ is off and analog switch $C_i$ is on, the output potential of source driver $SD_i$ is fed back to the inverting input terminal of source driver $SD_i$ via analog switch $C_i$. Since the input impedance of the inverting input of source driver $SD_i$ is extremely high, the potential at the inverting input terminal of source driver $SD_i$ becomes equal to the output potential of source driver $SD_i$ regardless of the on-resistance in analog switch $C_i$. Since source driver $SD_i$ operates so as to make the potential of its inverting input (the output potential of source driver $SD_i$) equal to the potential of its non-inverting input (source driving signal $SS_i$), the output potential of source driver $SD_i$ equals the potential of source driving signal $SS_i$.

At the transition from the precharging period to the driving period, switch control signal PC goes to the '0' logic level and switch control signal PCB goes to the '1' logic level, switching all the C- and E-group analog switches off and all the A- and B-group analog switches on.

Analog switch $E_i$ (or $E_{i-1}$) accordingly turns off and analog switch $A_i$ turns on, disconnecting output terminal $OUT_i$ (source line $S_i$) from the adjacent output terminal $OUT_{i+1}$ (source line $S_{i+1}$) or $OUT_{i-1}$ (source line $S_{i-1}$) and connecting it to the output terminal of source driver $SD_i$ via analog switch $A_i$ and protective resistor $a_i$.

Analog switch $C_i$ turns off and analog switch $B_i$ turns on, switching from the second feedback path to the first feedback path, thereby feeding back the potential of output terminal $OUT_i$ (source line $S_i$) after the voltage drop caused by the on-resistance of analog switch $A_i$ and the resistance of the protective resistor $a_i$ to the inverting input terminal of source driver $SD_i$ via analog switch $B_i$. Since the input impedance at the inverting input terminal of source driver $SD_i$ is extremely high, the potential at the inverting input terminal of source driver $SD_i$ rapidly becomes equal to the potential of output terminal $OUT_i$ (source line $S_i$) despite the presence of feedback resistor $b_i$. Since source driver $SD_i$ operates so as to make the potential of its inverting input (the potential of output terminal $OUT_i$ or source line $S_i$) equal to the potential of its non-inverting input (source driving signal $SS_i$), the potential of output terminal $OUT_i$ (source line $S_i$) rapidly becomes equal to the potential of source driving signal $SS_i$.

At the precharging-to-driving transition, accordingly, the source driving circuit 20 in the second embodiment switches the feedback potential of the i-th output circuit from the potential at a point preceding analog switch $A_i$ to the potential at a point following protective resistor $a_i$, thereby compensating for the voltage drop due to the on-resistance of analog switch $A_i$ and protective resistor $a_i$, so that the potential of output terminal $OUT_i$ (source line $S_i$) quickly becomes equal to the potential of source driving signal $SS_i$ (the output potential of source driver $SD_i$). This feedback arrangement also compensates for variations in voltage drop due to variations in the resistance of the protective resistors and the on-resistance of the analog switches, resulting in both faster and more accurate driving of the source lines.

This feedback arrangement can also compensate for the voltage drop due to the resistance of the signal line from the output terminal of source driver $SD_i$ to the point at which analog switches $A_i$ and $B_i$ are interconnected, which accounts for most of the wiring resistance on the signal path from the output terminal of source driver $SD_i$ to output terminal $OUT_i$. This means that, if there are variations in wiring resistance (or wiring length) on the output paths, they can be compensated for completely, or almost completely, by interconnecting the analog switches $A_i$ and $B_i$ at output terminal $OUT_i$ or at a point located as near as possible to output terminal $OUT_i$.

During the driving period, switch control signal PC is '0' and switch control signal PCB is '1', so the A- and B-group analog switches are all in the on state and the C- and E-group analog switches are all in the off state.

Analog switch $E_i$ (or $E_{i-1}$) is in the off state, and analog switch $A_i$ is in the on state, disconnecting output terminal $OUT_i$ (source line $S_i$) from the adjacent output terminal $OUT_{i+1}$ (source line $S_{i+1}$) or $OUT_{1-1}$ (source line $S_{i-1}$) and connecting it to the output terminal of source driver $SD_i$ via analog switch $A_i$.

Analog switch $C_i$ is in the off state and analog switch $B_i$ is in the on state, feeding the potential of output terminal $OUT_i$ (source line $S_i$) back via feedback resistor $b_i$ and analog switch $B_i$ on the first feedback path to the inverting input terminal of source driver $SD_i$, thereby keeping the potential of output terminal $OUT_i$ (source line $S_i$) equal to the potential of the non-inverting input (source driving signal $SS_i$) of source driver $SD_i$.

At the transition from the driving period to the next precharging period, switch control signal PC goes to '1' and switch control signal PCB goes to '0', switching all the A- and B-group analog switches off and all the C- and E-group analog switches on.

Analog switches $A_i$ and $B_i$ turn off and analog switch $E_i$ (or $E_{i-1}$) turns on, disconnecting output terminal $OUT_i$ (source line $S_i$) from the output and inverting input terminals of source driver $SD_i$, and connecting output terminal $OUT_i$ to adjacent output terminal $OUT_{i+1}$ (source line $S_{i+1}$) or $OUT_{i-1}$ (source line $S_{i-1}$) via analog switch $E_i$ (or $E_{i-1}$), thereby precharging source line $S_i$ to the average potential of source line $S_i$ (output terminal $OUT_i$) and the adjacent source line $S_{i+1}$ or $S_{i-1}$ (output terminal $OUT_{i+1}$ or $OUT_{i-1}$) during the preceding driving period.

Analog switch $B_i$ turns off and analog switch $C_i$ turns on, switching the feedback path from the first feedback path to the second feedback path, thereby feeding the output potential of source driver $SD_i$ back to the inverting input terminal of source driver $SD_i$ via analog switch $C_i$.

As described above, the second embodiment provides a first feedback path from a point following the protective resistor to the source driver during the driving period and a second feedback path from a point preceding the A-group analog switch to the source driver during the precharging period, and switches the feedback path at transitions from the driving period to the precharging period and vice versa, thereby compensating for the voltage drop due to the on-resistance of the analog switch and the resistance of the protective resistor, and further compensating for variations in on-resistance and wiring resistance of the output path. The second embodiment thereby achieves fast and highly accurate liquid crystal driving. The second embodiment also conserves power by precharging each source line from an adjacent source line, and reduces the number of analog switches that control precharging by providing only one such switch for each two source lines.

Third Embodiment

Figure 6:
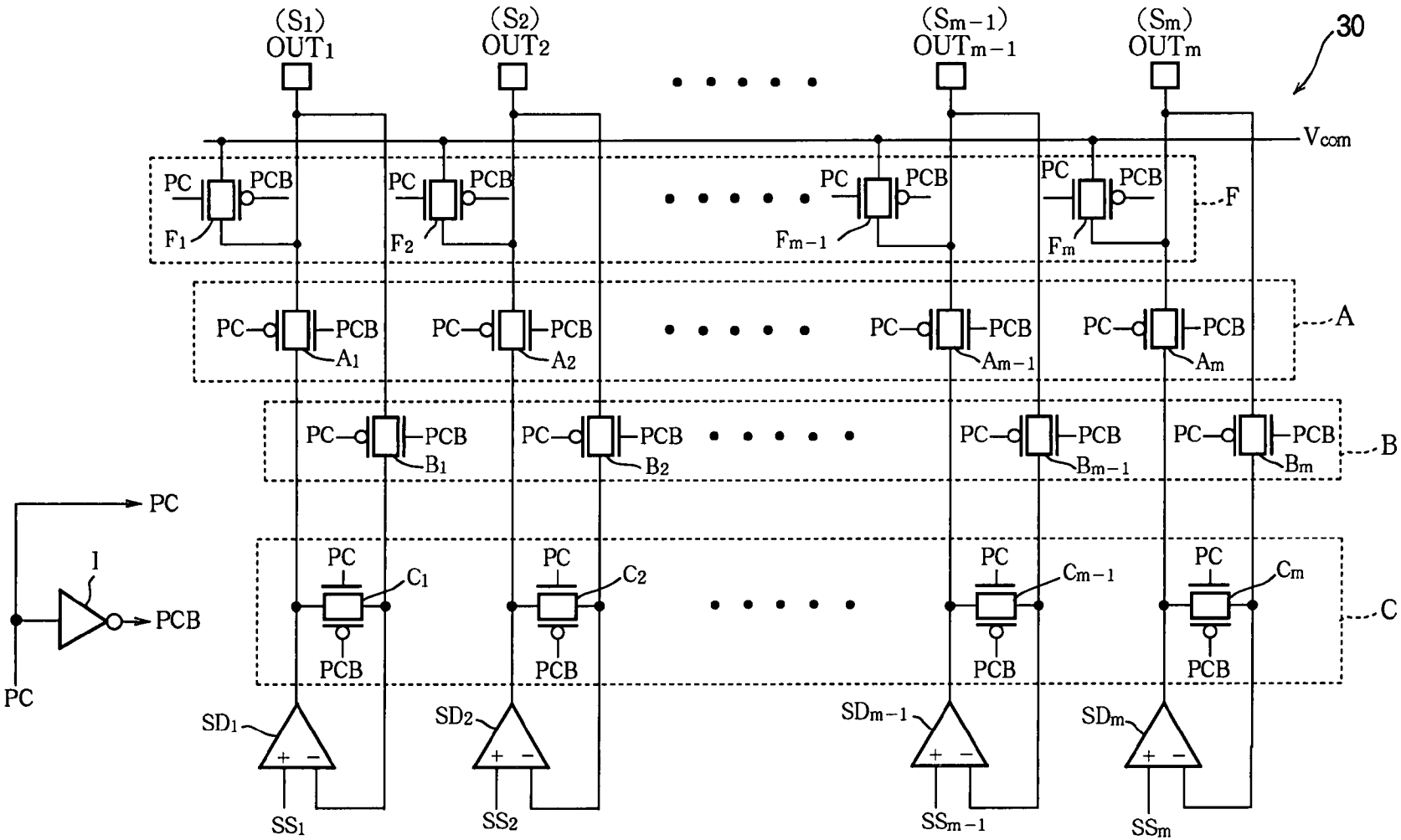
FIG. 6 is a circuit diagram of the source driving circuit in a third embodiment.

Referring to FIG. 6, the source driving circuit 30 in the third embodiment comprises m source drivers $SD_1$, $SD_2$, . . . , $SD_m$, an A-group of analog switches that control output paths, a B-group of analog switches that control first feedback paths, a C-group of analog switches that control second feedback paths, an F-group of analog switches that control precharging, a group of m output terminals $OUT_1$, $OUT_2$, . . . , $OUT_m$, and an inverter I, where m is an arbitrary integer equal to or greater than two.

The source driving circuit 30 in the third embodiment accordingly alters the group of analog switches that control precharging in the source driving circuit 10 (see FIGS. 1 and 2) in the first embodiment.

The F-group of analog switches comprises m analog switches (MOS switches) $F_1$, $F_2$, . . . , $F_m$. Analog switch $F_i$ is connected between the i-th output terminal $OUT_i$ (source line $S_i$) of the source driving circuit 30 and the common voltage $V_{com}$ (the potential of the common electrode of the liquid crystal capacitors). The gate electrode of the PMOS transistor in analog switch $F_i$ receives the switch control signal PCB output from the inverter I; the gate electrode of the NMOS transistor in analog switch $F_i$ receives switch control signal PC. Analog switch $F_i$ turns on when PC=1 (PCB=0), thereby connecting output terminal $OUT_i$ (source line $S_i$) to the common voltage $V_{com}$; analog switch $F_i$ turns off when PC=0 (PCB=1), thereby disconnecting output terminal $OUT_i$ (source line $S_i$) from the common voltage $V_{com}$. The third embodiment uses the common voltage $V_{com}$ for precharging the source lines (the output terminals of the source driving circuit). The common voltage $V_{com}$ is, for example, half the potential of the power supply voltage supplied to source drivers $SD_1$ to $SD_m$, this being the midpoint potential in the output range of source drivers $SD_1$ to $SD_m$.

In the source driving circuit 30 of the third embodiment, source driver $SD_i$, analog switches $A_i$, $B_i$, $C_i$, and $F_i$, and output terminal $OUT_i$ form an output circuit.

Figure 7:
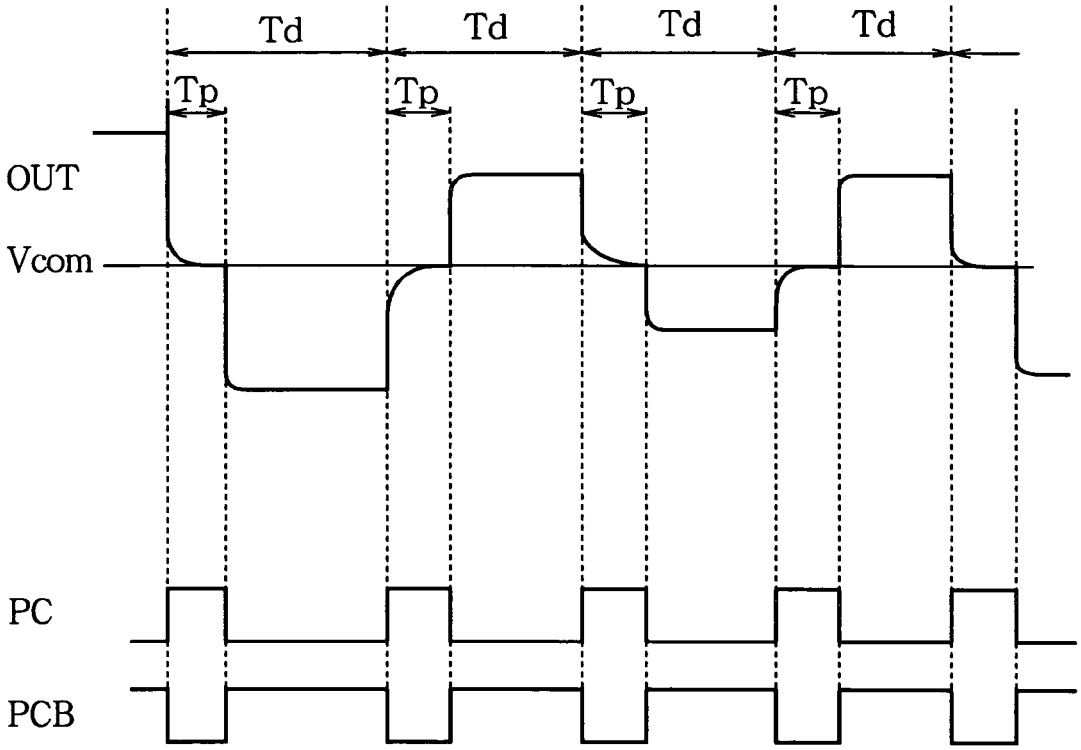
FIG. 7 is a timing waveform diagram illustrating the operation of the source driving circuit in the third embodiment.
Figure 8:
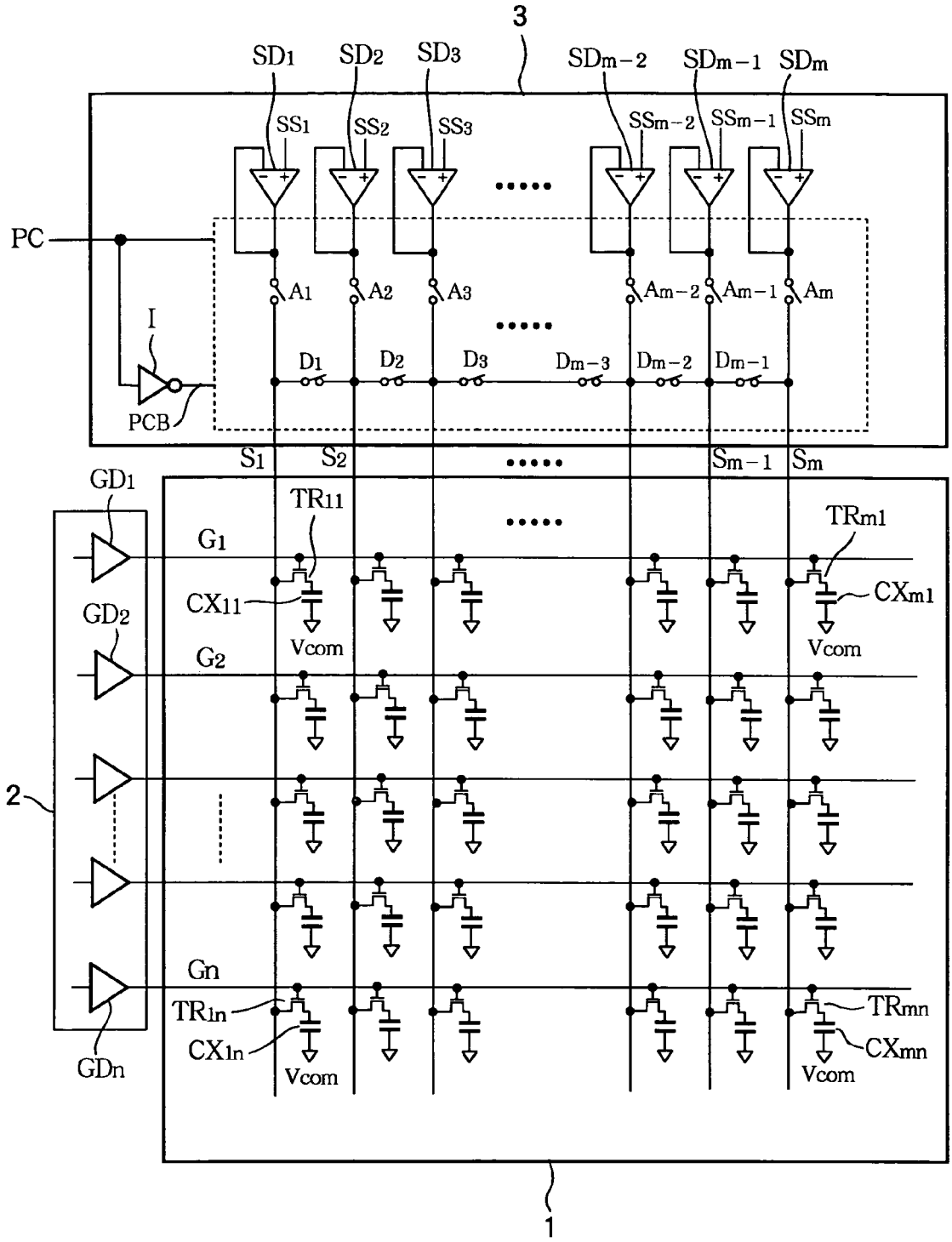
FIG. 8 is a circuit diagram of a liquid crystal display according to the prior art.
Figure 9:
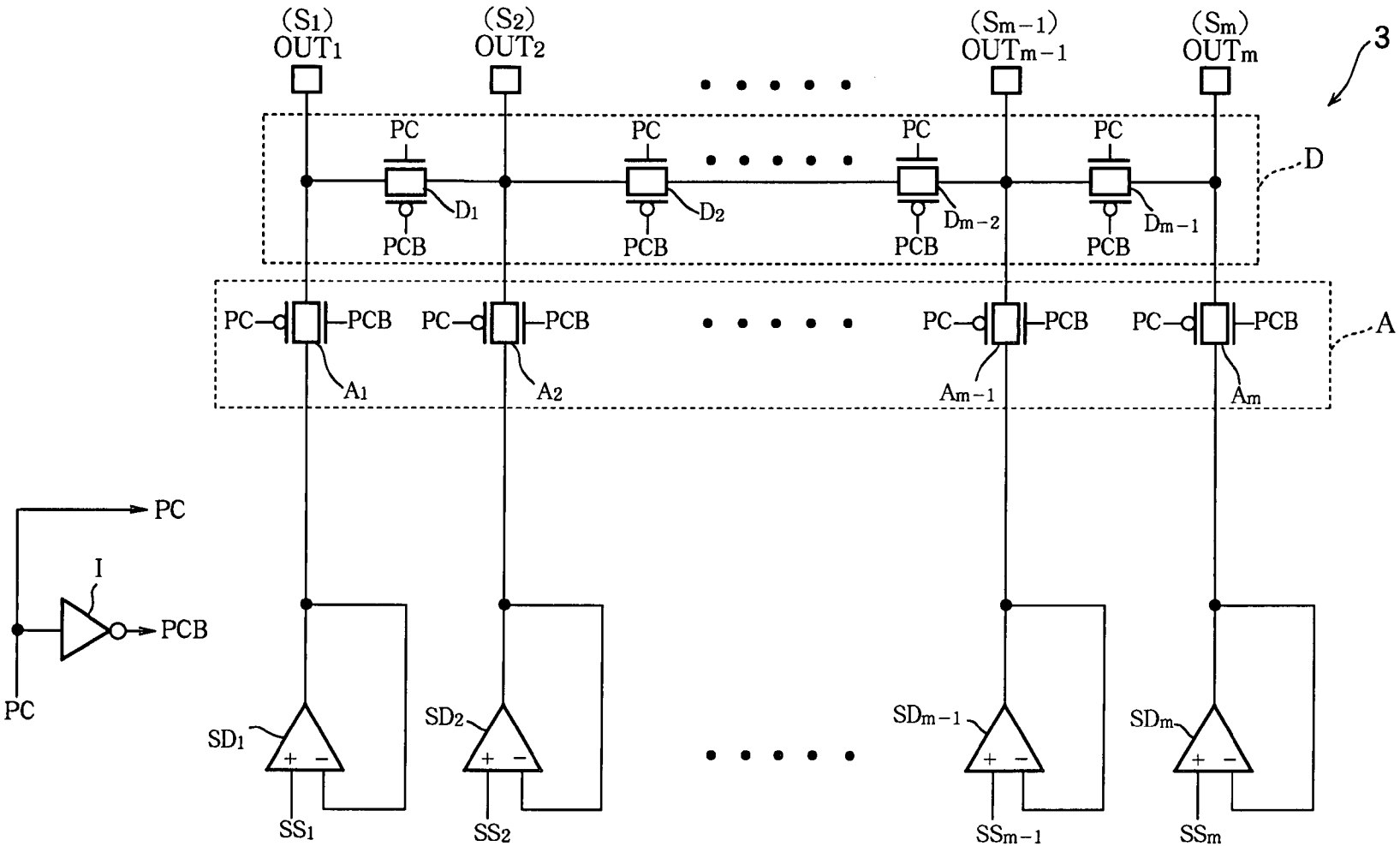
FIG. 9 is a more detailed circuit diagram of the source driving circuit in FIG. 8.

The operation of the source driving circuit 30 in the third embodiment will be described below with reference to FIG. 7, which shows waveforms of an output signal OUT of the source driving circuit 30 (the signal output from output terminal $OUT_i$ to source line $S_i$), the switch control signal PC and the complementary switch control signal PCB. $T_d$ indicates the dot driving cycle time of the liquid crystal display; $T_p$ indicates the precharging period.

During a precharging period, switch control signal PC (the input signal to inverter I) is '1' and switch control signal PCB (the output signal from inverter I) is '0', so the A- and B-group analog switches are all in the off state, while the C- and F-group analog switches are all in the on state.

Since analog switches $A_i$ and $B_i$ are in the off state and analog switch $F_i$ is in the on state, output terminal $OUT_i$ (source line $S_i$) is disconnected from the output and inverting input terminals of source driver $SD_i$ and is connected via analog switches $F_i$ to the common voltage $V_{com}$, thereby being precharged to the $V_{com}$ potential.

Since analog switch $B_i$ is off and analog switch $C_i$ is on, the output potential of source driver $SD_i$ is fed back to the inverting input terminal of source driver $SD_i$ via analog switch $C_i$. Since the input impedance of the inverting input of source driver $SD_i$ is extremely high, the potential at the inverting input terminal of source driver $SD_i$ becomes equal to the output potential of source driver $SD_i$ regardless of the on-resistance in analog switch $C_i$. Since source driver $SD_i$ operates so as to make the potential of its inverting input (the output potential of source driver $SD_i$) equal to the potential of its non-inverting input (source driving signal $SS_i$), the output potential of source driver $SD_i$ equals the potential of source driving signal $SS_i$.

At the transition from the precharging period to the driving period, switch control signal PC goes to the '0' logic level and switch control signal PCB goes to the '1' logic level, switching all the C- and F-group analog switches off and all the A- and B-group analog switches on.

Analog switch $F_i$ accordingly turns off and analog switch $A_i$ turns on, disconnecting output terminal $OUT_i$ (source line $S_i$) from the common voltage $V_{com}$ and connecting it to the output terminal of source driver $SD_i$ via analog switch $A_i$.

Analog switch $C_i$ turns off and analog switch $B_i$ turns on, switching from the second feedback path to the first feedback path, thereby feeding back the potential of output terminal $OUT_i$ (source line $S_i$) after the voltage drop caused by the on-resistance of analog switch $A_i$ to the inverting input terminal of source driver $SD_i$ via analog switch $B_i$. Since the input impedance at the inverting input terminal of source driver $SD_i$ is extremely high, the potential at the inverting input terminal of source driver $SD_i$ rapidly becomes equal to the potential of output terminal $OUT_i$ (source line $S_i$) regardless of the on-resistance of analog switch $B_i$. Since source driver $SD_i$ operates so as to make the potential of its inverting input (the potential of output terminal $OUT_i$ or source line $S_i$) equal to the potential of its non-inverting input (source driving signal $SS_i$), the potential of output terminal $OUT_i$ (source line $S_i$) rapidly becomes equal to the potential of source driving signal $SS_i$.

At the precharging-to-driving transition, accordingly, the source driving circuit 30 in the third embodiment switches the feedback potential of the i-th output circuit from the potential at a point preceding analog switch $A_i$ to the potential at a point following analog switch $A_i$, thereby compensating for the voltage drop due to the on-resistance of analog switch $A_i$ so that the potential of output terminal $OUT_i$ (source line $S_i$) quickly becomes equal to the potential of source driving signal $SS_i$ (the input potential to source driver $SD_i$). This feedback arrangement also compensates for variations in voltage drop due to variations in on-resistance, resulting in both faster and more accurate driving of the source lines.

This feedback arrangement can also compensate for the voltage drop due to the resistance of the signal line from the output terminal of source driver $SD_i$ to the point at which analog switches $A_i$ and $B_i$ are interconnected, which accounts for most of the wiring resistance on the signal path from the output terminal of source driver $SD_i$ to output terminal $OUT_i$. This means that, if there are variations in wiring resistance (or wiring length) on the output paths, they can be compensated for completely, or almost completely, by interconnecting the analog switches $A_i$ and $B_i$ at output terminal $OUT_i$ or at a point located as near as possible to output terminal $OUT_i$.

During the driving period, switch control signal PC is '0' and switch control signal PCB is '1', so the A- and B-group analog switches are all in the on state and the C- and F-group analog switches are all in the off state.

Analog switch $F_i$ is in the off state, and analog switch $A_i$ is in the on state, disconnecting output terminal $OUT_i$ (source line $S_i$) from the common voltage $V_{com}$ and connecting it to the output terminal of source driver $SD_i$ via analog switch $A_i$.

Analog switch $C_i$ is in the off state and analog switch $B_i$ is in the on state, feeding the potential of output terminal $OUT_i$ (source line $S_i$), which is the output potential of source driver $SD_i$ minus the voltage drop due to the on-resistance of analog switch $A_i$, back via analog switch $B_i$ to the inverting input terminal of source driver $SD_i$, thereby keeping the potential of output terminal $OUT_i$ (source line $S_i$) equal to the potential of the non-inverting input (source driving signal $SS_i$) of source driver $SD_i$.

At the transition from the driving period to the next precharging period, switch control signal PC goes to '1' and switch control signal PCB goes to '0', switching all the A- and B-group analog switches off and all the C- and F-group analog switches on.

Analog switches $A_i$ and $B_i$ turn off and analog switch $F_i$ turns on, disconnecting output terminal $OUT_i$ (source line $S_i$) from the output and inverting input terminals of source driver $SD_i$, and connecting output terminal $OUT_i$ to the common voltage $V_{com}$, thereby precharging source line $S_i$ to the $V_{com}$ potential.

Analog switch $B_i$ turns off and analog switch $C_i$ turns on, switching from the first feedback path to the second feedback path, thereby feeding the output potential of source driver $SD_i$ back to the inverting input terminal of source driver $SD_i$ via analog switch $C_i$.

As described above, the third embodiment provides a first feedback path from a point following the A-group analog switch to the source driver during the driving period and a second feedback path from a point preceding the A-group analog switch to the source driver during the precharging period, and switches the feedback path at transitions from the driving period to the precharging period and vice versa, thereby compensating for the voltage drop due to the on-resistance of the analog switch in the driving period, and further compensating for variations in on-resistance and wiring resistance of the output path. The third embodiment thereby achieves fast and highly accurate liquid crystal driving.

Those skilled in the art will recognize that many modifications can be made to the above embodiments within the scope of the invention, which is defined in the appended claims.

What is claimed is:

1. An output circuit having an impedance conversion element generating an output signal from an input signal and a feedback signal, and an output path that conducts the output signal from the impedance conversion element to an output terminal, the output circuit also comprising:

a first switch disposed on the output path, for conducting the output signal during an output period and blocking the output signal during a non-output period;

a second switch for conducting the output signal from a first point on the output path to the impedance conversion element as the feedback signal during the output period, the first point being disposed at the output terminal or between the first switch and the output terminal; and a third switch for conducting the output signal from a second point on the output path to the impedance conversion element as the feedback signal during the non-output period, the second point being disposed between the impedance conversion element and the first switch.

2. The output circuit of claim 1, further comprising:

a protective resistor connecting the first point to the first switch; and a feedback resistor connecting the first point to the second switch.

3. The output circuit of claim 1, further comprising a fourth switch for connecting the output terminal to a fixed power supply during the non-output period.

4. The output circuit of claim 1, wherein the impedance conversion element is an operational amplifier having an inverting input terminal for receiving the feedback signal.

5. The output circuit of claim 1, wherein the first, second, and third switches are analog switches controlled by a switch control signal, the first and second switches being turned on when the switch control signal is at a first logic level and being turned off when the switch control signal is at a second logic level, the third switch being turned off when the switch control signal is at the first logic level and being turned on when the switch control signal is at the second logic level.

6. A liquid crystal driving circuit for driving a liquid crystal panel, the liquid crystal driving circuit comprising a plurality of output circuits as described in claim 1, the liquid crystal panel having a plurality of signal lines connected to the output terminals of the driving circuits, the impedance conversion element of each output circuit thus functioning as a signal line driver.

7. The liquid crystal driving circuit of claim 6, further comprising at least one fourth switch for interconnecting said signal lines during the non-output period.

8. The liquid crystal driving circuit of claim 6, further comprising at least one fourth switch for interconnecting a mutually adjacent pair of said signal lines during the non-output period.

9. The liquid crystal driving circuit of claim 6, further comprising a plurality of fourth switches for connecting said signal lines to a fixed power supply during the non-output period.

10. A method of driving a liquid crystal panel having a plurality of signal lines by using a plurality of drivers generating respective output signals from respective input signals and respective feedback signals, the method comprising:

connecting the drivers to a plurality of output terminals to which said signal lines are connected via respective switches disposed between the drivers and the output terminals, thereby using the output signals of the drivers to drive said signal lines, and returning the output signals from connection points disposed between the switches and the output terminals to the drivers as said feedback signals while the drivers are connected; and disconnecting the drivers from the output terminals and precharging said signal lines while using the output signals of the drivers as said feedback signals.

11. The method of claim 10, wherein precharging said signal lines comprises interconnecting said signal lines.

12. The method of claim 10, wherein precharging said signal lines comprises interconnecting mutually adjacent pairs of said signal lines.

13. The method of claim 10, wherein precharging said signal lines comprises connecting said signal lines to a fixed power supply.

* * * * *